United States Patent [19]

Sharp

[11] Patent Number: 4,915,253

[45] Date of Patent: Apr. 10, 1990

[54] REMOVABLE CENTER-POINT COMPRESSION SEALING LID MEMBER

[76] Inventor: Bruce R. Sharp, 22375 Edgewater Dr., Unit 241, Charlotte Harbor, Fla. 33980

[21] Appl. No.: 316,796

[22] Filed: Feb. 28, 1989

Related U.S. Application Data

[63] Continuation-in-part of Ser. No. 66,701, Jun. 26, 1987, which is a continuation-in-part of Ser. No. 50,696, May 18, 1987, Pat. No. 807,675, which is a continuation-in-part of Ser. No. 858,656, May 1, 1986, abandoned.

[51] Int. Cl.[4] ..... B65D 45/28

[52] U.S. Cl. ..... 220/314

[58] Field of Search ..... 220/314, 315, 323; 215/200

[56] References Cited

U.S. PATENT DOCUMENTS

| | | | |
|---|---|---|---|
| 3,722,549 | 3/1973 | Wilson et al. | 138/89 |
| 3,924,778 | 12/1975 | Sorensen | 220/314 |
| 4,098,427 | 7/1978 | Duckworth, Jr. | 220/259 |
| 4,127,215 | 11/1978 | Morrison | 220/314 |
| 4,351,446 | 9/1982 | Madden | 220/210 |

FOREIGN PATENT DOCUMENTS

| | | | |
|---|---|---|---|
| 168408 | 6/1934 | Switzerland | 220/314 |

*Primary Examiner*—Donald F. Norton
*Attorney, Agent, or Firm*—Charles R. Wilson

[57] ABSTRACT

A center-point compression sealing lid member for use on containers of all sorts is described. The lid member is completely removable from the container. The lid member comprises a cover with a spacer positioned in its approximate center, a force transfer bar permanently positioned over the spacer and extending across the cover with means on one extremity to engage a retaining means on the container, and a lever bar pivotably mounted on the force transfer bar's second extremity to engage a second retaining means on the container. When the lid member is properly positioned over the container's opening with the means on the first extremity of the force transfer bar and the lever bar aligned with the retaining means found on the container and downward force exerted on the lever bar, the force is transmitted through the spacer to the cover. Substantially equal force is exerted by the cover's peripheral edges onto edges of the container's top opening to form a liquid-tight seal.

19 Claims, 6 Drawing Sheets

REMOVABLE CENTER-POINT COMPRESSION SEALING LID MEMBER

This application is a continuation in part of "Liquid Overfill Tank Assembly", Ser. No. 07/066,701, filed June 26, 1987, which is a continuation in part of "Overfill Assembly with Removable Lid", Ser. No. 07/050,696, filed May 18, 1987, now U.S. Pat. No. 4,807,675, which is a continuation in part of "Overfill Tanks For Use on Storage Tanks", Ser. No. 06/858,656, filed May 1, 1986, now abandoned.

This invention relates to a lid member for use on open-top containers. More particularly, the invention relates to a container wherein a lid member is completely removable and seals by a center-point compression sealing mechanism.

BACKGROUND OF THE INVENTION

Lids of several designs have been devised and used to seal containers. The various designs are dictated in part by the container's structural features and in part by the seal needed. Open-top containers are very prevalent; they range in capacity from a few ozs. to several gallons. Their uses also range from solid or liquid food containment to solid or liquid hazardous material containment. Different degrees of seals are also possible. All of the aforementioned criteria enter into the particular lid design which must be used.

A particulary effective liquid-tight seal is obtained from the class of lids known as center-point compression sealing lids. The lids are used with open-top containers. In these lids, a force is exerted in the center of the lid. The force is transmitted to the lid's periphery to result in substantially equal pressure at the edges. Known center-point compression sealing lids are hinged at one edge. A latching mechanism on the container opposite the hinged edge is used to effect a means to receive force. Means on the container and lid act in concert to provide a very good seal.

A drawback experienced with hinged-type center-point compression lids is the fact the lid is always attached to the containers. As such it can hinder the use of the container. The container is more difficult to fill and empty because of the lid's somewhat bulky presence. However, this known drawback is outweighed by the lid's advantages. As a result various fill and emptying means have been adapted for use on the hinged lid containers.

There has now been devised a lid which has all the advantages of center-point compression sealing lids, yet is completely removable from the container when not needed. The lid member of this invention retains all the advantages of known systems, but not their prime disadvantage.

SUMMARY OF THE INVENTION

A center-point compression sealing lid member is for use on containers with a top opening. The lid member is completely removable. The lid member comprises a cover dimensioned to completely overlie the container's opening, a spacer attached to the cover in its approximate center, a force transfer bar permanently attached to the spacer and a lever bar pivotably mounted on the force transfer bar. Retaining means, found on the container, receive one extremity of the force transfer bar and one extremity of the lever bar. When a downward force is exerted on the lever bar, the force is transmitted to the cover's periphery which contacts the edges of the container's top opening. Substantially equal force is exerted on the edges to provide a liquid-tight seal. The lid member is completely removable from the container so as to not hinder its use.

DETAILED DESCRIPTION OF THE INVENTION

The invention is described with reference to the drawings. The container and lid member are described in detail as well as their mode of operation.

Containers useful with the lid member of this invention have a volumetric capacity of at least about one gallon, preferably about five gallons to about one hundred gallons. Containers of all shapes and sizes can be used. Preferred are those containers having a neck extending from a main body. Also preferred are those containers where a top edge of the opening over which a cover is positioned is flattened with a circumferential groove. The groove is used for holding an O-ring gasket.

Figure 1:
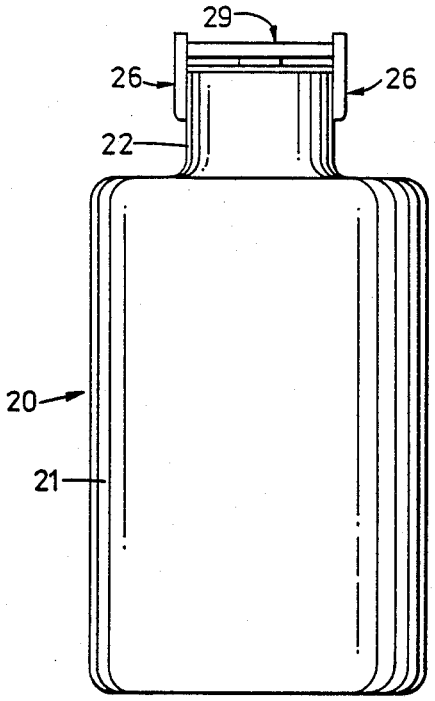
FIG. 1 is a side view of a container with the lid member of this invention.
Figure 2:
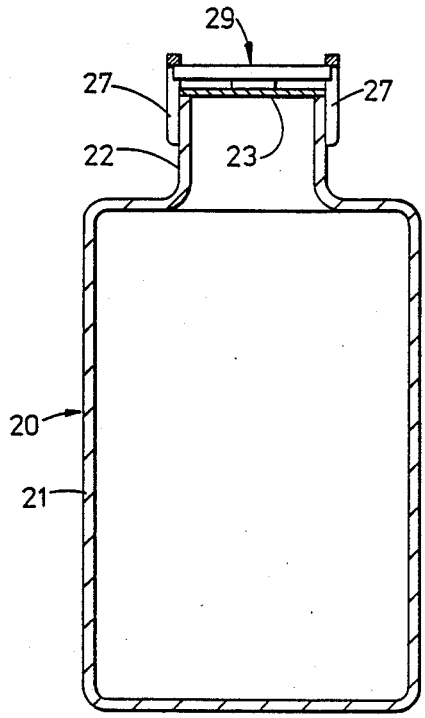
FIG. 2 is a side view in section of the container and lid member of FIG. 1.
Figure 3:
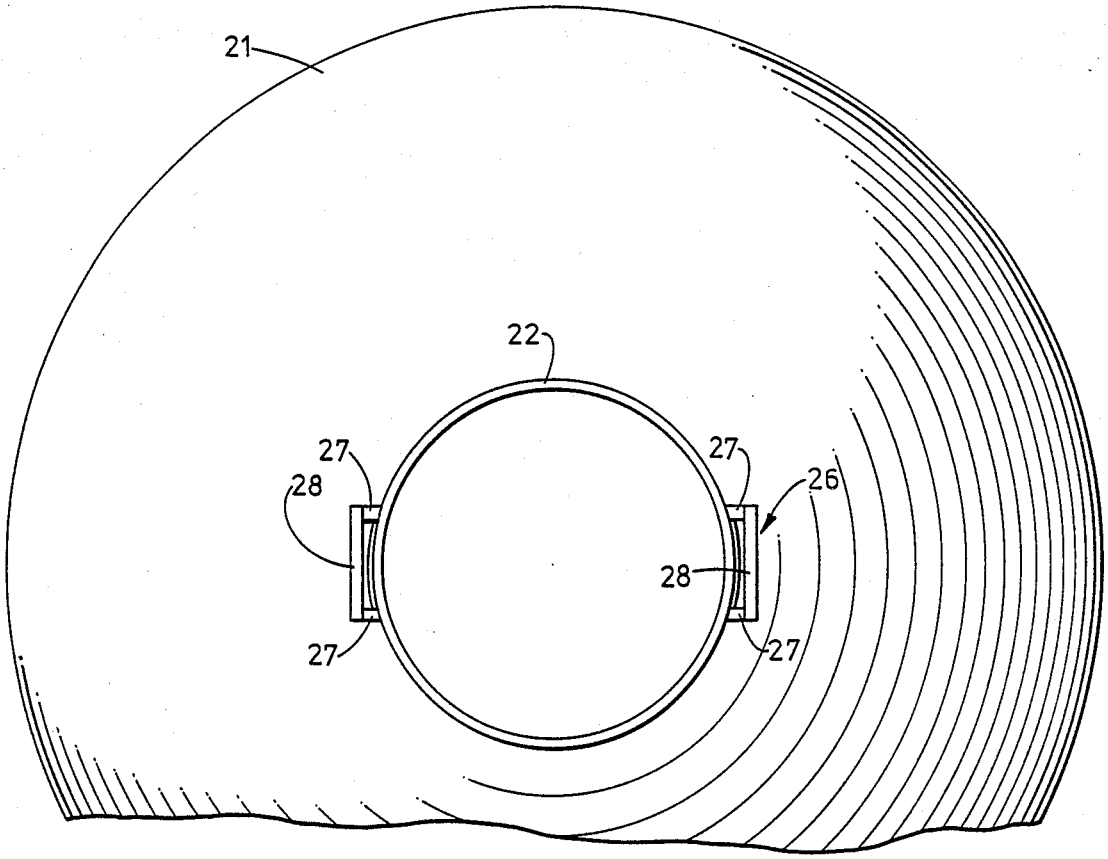
FIG. 3 is a top view of the container of FIG. 1 with the lid member removed.
Figure 4:
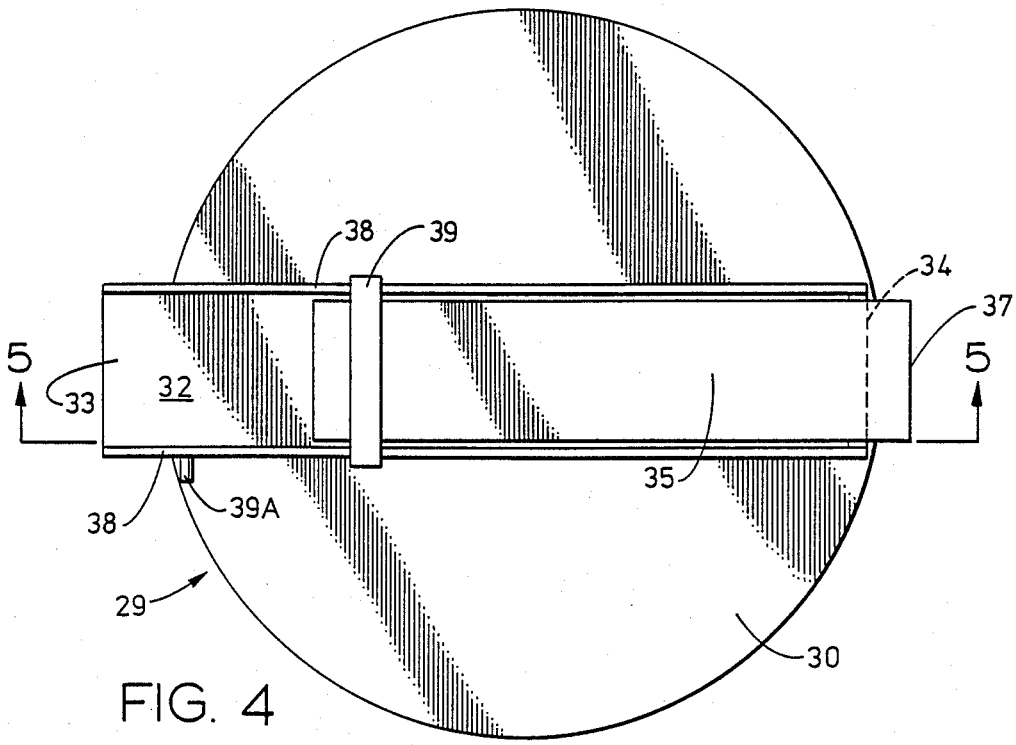
FIG. 4 is a top view of the center-point compression sealing lid member found on the container of FIG. 1.
Figure 5:
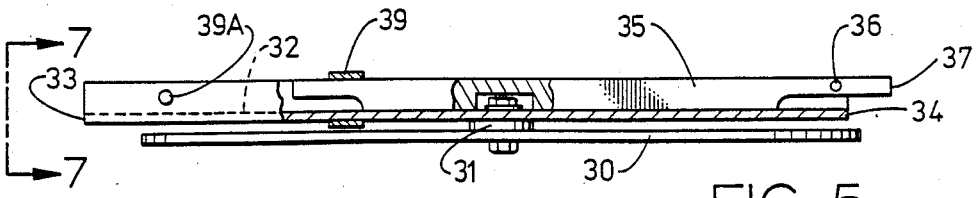
FIG. 5 is a side view in section of the lid member of FIG. 4.
Figure 6:
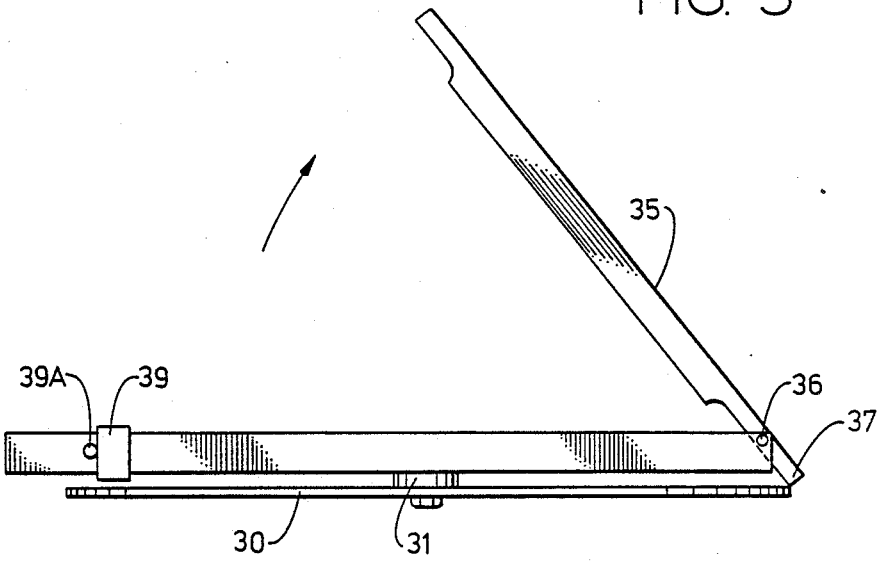
FIG. 6 is a side view of the lid member of FIG. 4 with its lever bar raised.
Figure 7:
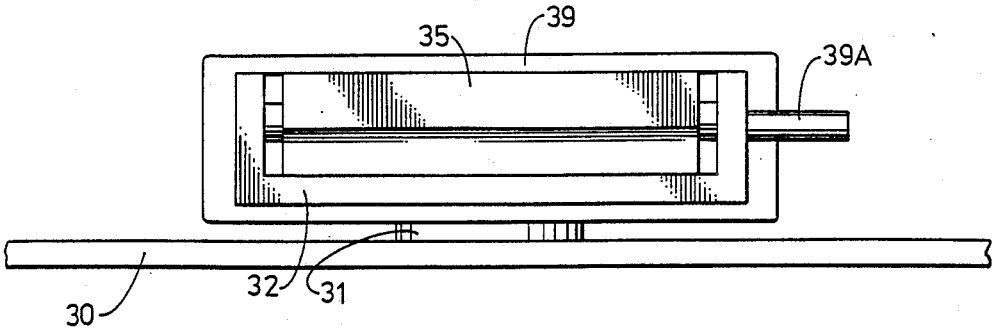
FIG. 7 is a partial end view of the lid member of FIG. 4.
Figure 8:
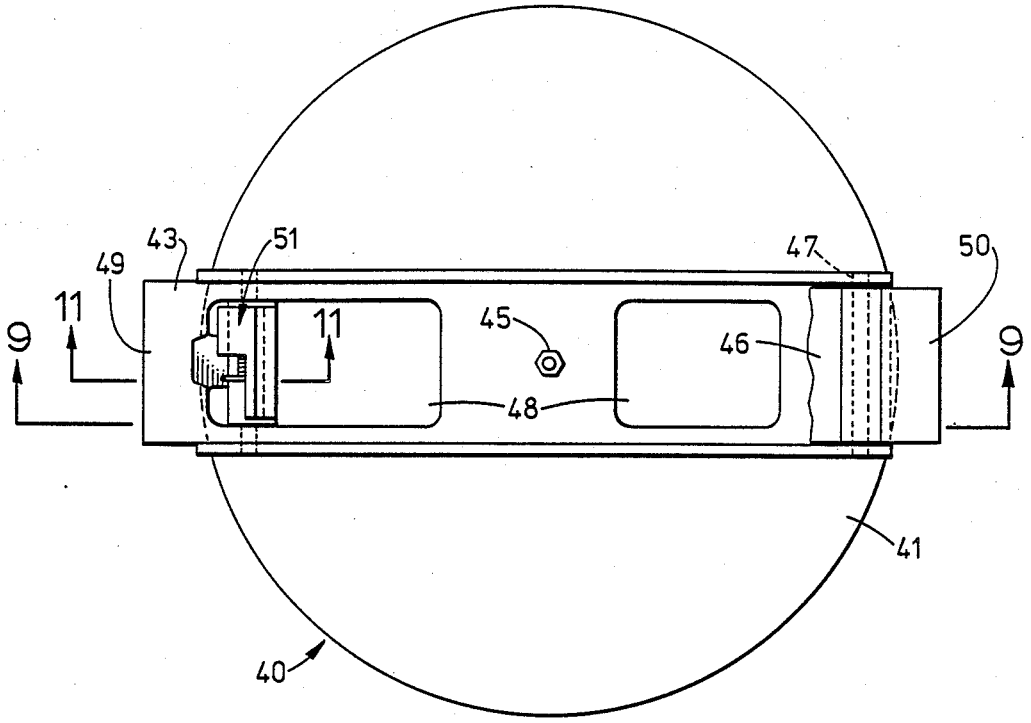
FIG. 8 is a top view of another center-point compression sealing lid member of the invention.
Figure 9:
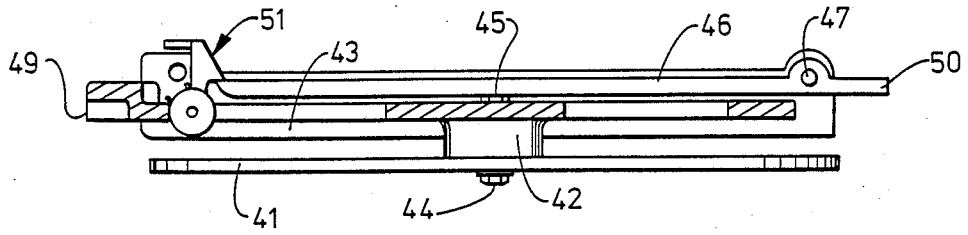
FIG. 9 is a side view in section taken of a lid member along lines 9—9 of FIG. 8.
Figure 10:
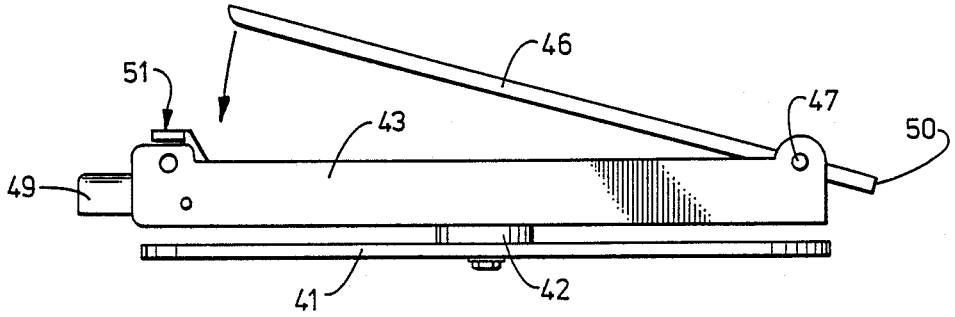
FIG. 10 is a side view of the lid member of FIG. 8.

With reference to FIGS. 1 and 2 there is shown generally a container 20. The container has a cylindrical-shaped body 21 and an elongated neck 22. A top opening 23 is used to gain access to the container 20's interior. Containers of this general nature are well known. The neck 22 has retaining means 26 for accommodating a sealing removable lid member. As best seen in FIGS. 2 and 3, the retaining means is two sets of brackets 27 extending from the neck opposite one another. The brackets are attached by bolts or other suitable means to the neck. A retainer cross-pin 28 extends across the brackets and is for the purpose of receiving a lid member. In accord with this invention, a removable center-point compression lid member 29 is used. The lid member is removable so as to aid in the container's use. Complete removal of the lid member allows the user to set it aside during a fill or empty operation. At the same time, the excellent sealing qualities of a center point compression lid member are retained.

FIGS. 4–7 show in detail the lid member 29 of FIG. 1. Cover 30 is dimensioned to fit over the opening at the container's neck. The cover has a center point spacer 31 attached in the approximate center of the cover. A force transfer bar 32 is attached to the spacer 31. The force transfer bar 32 extends substantially across and through the middle of cover 30. End 33 of the force transfer bar extends over an edge of the cover. A second end 34, extending to near an opposite edge of cover 30, has a lever bar 35 hingably attached to it by pin 36. The lever bar pivots about pin 36 to either exert or release a force when the lid member is in use. One end 37 of the lever bar extends past an edge of the cover. When lever bar 35 is forced downwardly during use, it preferably becomes flush with the force transfer bar 32. Ridges 38 on each side of the force transfer bar in effect provide a recessed inner area in which lever bar 35 fits. A latching means is provided to hold lever bar in place. As shown, a sliding ring 39 positioned on the force transfer bar is capable of sliding towards end 33 to allow lever bar 35 to drop into place, at which time sliding the ring back to cover the lever bar holds it in place. A protrusion 40 extending from the force transfer bar ensures that the ring will not slide off the transfer bar.

To seal off the container's interior, the removable lid member of FIGS. 4–7 is positioned over the container's opening depicted in FIGS. 2 and 3 and is closed by first placing end 33 of force transfer bar 32 under a retainer pin 28 at about a forty-five degree angle with lever bar 35 raised preferably ninety degrees perpendicular to cover 30. Once cover 30 is lowered and approximately horizontal, the lever bar is pushed down towards the force transfer bar resulting in end 37 of the lever bar being forced under a second retainer pin 28. After the lever bar is pushed down flush with the force transfer bar the sliding ring is slid over the lever bar. When the lever bar 35 is in the closed position down upon force transfer bar 32, the spacer 31 is forced downward thereby forcing cover 30 downward. The outer edge of cover 30 is forced down evenly on the top edges of the container's neck 22. The cover 30 is deflected into a concave structure formed by center point pressure of spacer 31 and effectively forms a tightly sealed enclosure.

Figure 11:
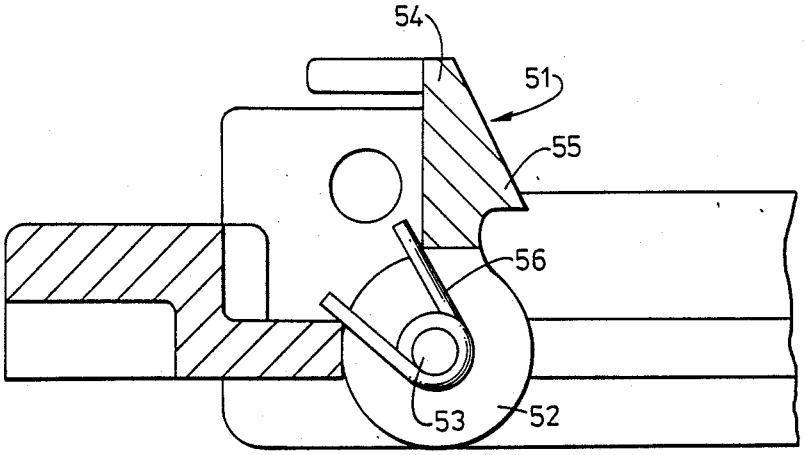
FIG. 11 is a side view in partial section of the lid member taken along lines 11—11 of FIG. 8 showing a latch means.

FIGS. 8–11 show another removable center-point compression lid member. Lid member 40 is similar to that described with reference to FIGS. 3–7. Cover 41 has a center point spacer 42 and a force transfer bar 43 held together by a bolt 44 and nut 45. Lever bar 46 is hingably attached to force transfer bar 43 by pin 47 positioned at one end thereof. Force transfer bar 43 has at least one opening 48 to allow water and debris to pass through and prevent any unwanted build-up on the cover. End 49 of the force transfer bar and end 50 of lever bar each extend over the edge of the cover 41 for purposes of fitting under retaining means found on a container. A spring latch 51 is provided on the force transfer bar to receive and hold one extremity of the lever bar. As best seen in FIG. 11, spring latch 51 has a body 52 which is attached by pin 53 to force transfer bar. The body has a thumb catch 54 which when pushed downwardly causes body 52 to revolve about its pin. Lip 55, holding the lever bar, is forced to revolve and release the lever bar. A spring 56 causes the body to return to its rest position when the force is removed from the thumb catch.

Figure 12:
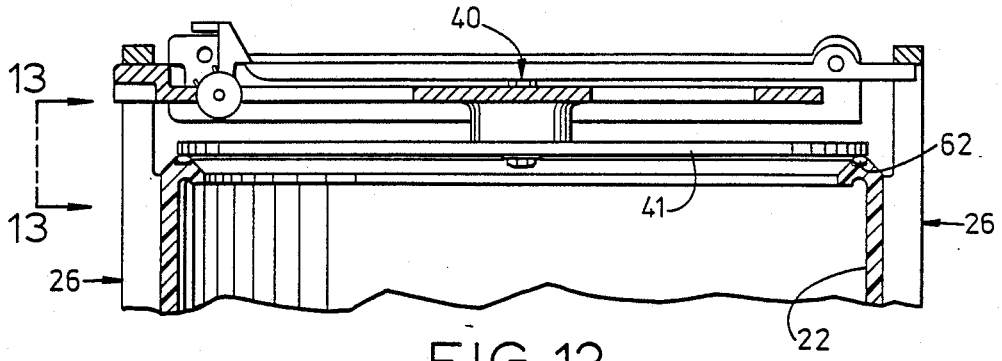
FIG. 12 is a partial view in section showing the use of a gasket and beveled top edge on a container's top opening when a lid member of this invention is sealed thereon.
Figure 13:
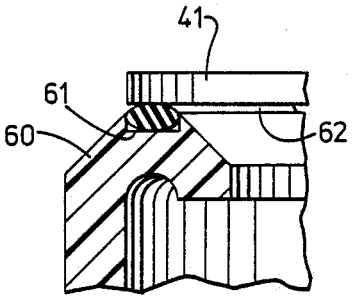
FIG. 13 is a fragmentary view showing a top edge of the container and lid member of FIG. 12.
Figure 14:
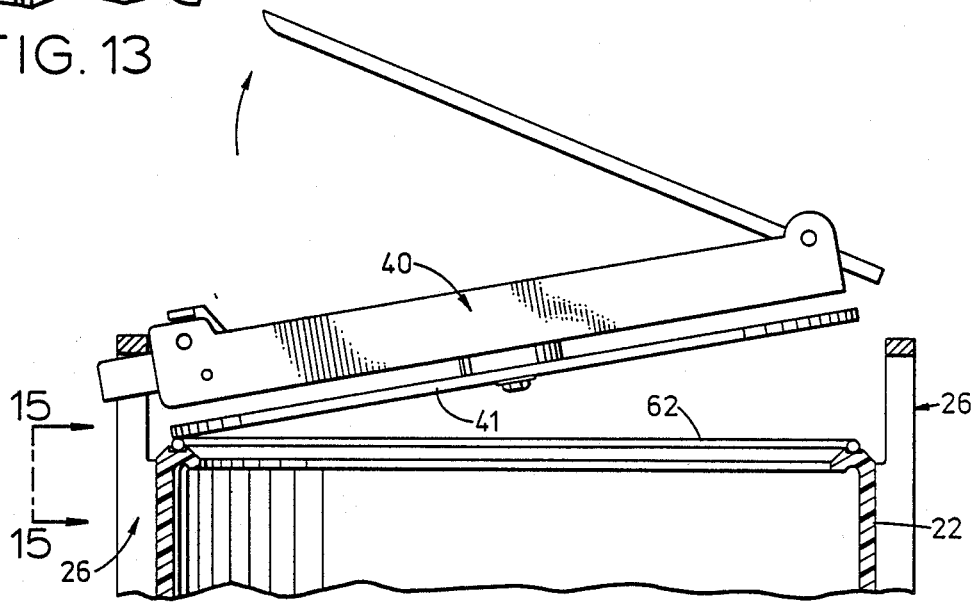
FIG. 14 is a partial view in section showing the top opening of the container of FIG. 12 when the lid member is under no sealing pressure.
Figure 15:
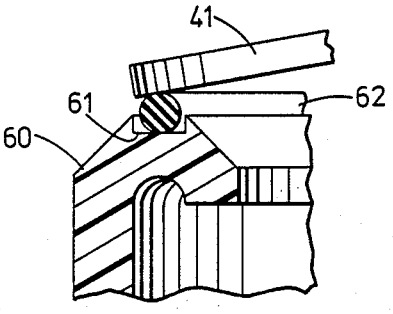
FIG. 15 is a fragmentary view showing a top edge of the container and lid member of FIG. 14.

FIGS. 12–15 illustrate a preferred embodiment of the invention. The top edge 60 of the container's neck 22 of FIG. 1 has a groove 61 to receive an O-ring gasket 62 and is bevelled on both the inside edge and outside edge. The O-ring is an especially effective gasket for sealing the interior of the container. Additionally, it has been found the O-ring serves a secondary advantage of absorbing some of the forces experienced when the lever bar is lowered. Without any kind of gasket material, lowering the lever bar causes the cover 41 to deflect downwardly with a tremendous amount of force at the cover edges. This force, when released by the latch means, causes the lever bar to spring upwardly. The use of an O-ring when steadied by the walls of the groove results in the force being absorbed by the O-ring itself and lessens transfer of force being through the cover to the lever bar when the latch is released. FIGS. 12 and 13 show the O-ring compressed as a result of pressure applied by the lid member. FIGS. 14 and 15 show the O-ring in a normal state when the lid member has been removed.

The top edge of the neck is bevelled downwardly both towards the outside and the inside of the neck walls. The combination of the O-ring and bevels results in a self-cleaning edge. That is, debris is not likely to remain on the top edge and interfere with obtaining a good seal.

While the cover assembly has been illustrated and described in detail in the drawings and foregoing description, the same is to be considered illustrative and not restrictive in character. Various modification can be made. It is understood that only preferred embodiments have been shown and described and that all obvious changes and modifications are within the spirit of the invention.

What is claimed is:

1. A completely removable center-point compression sealing lid member for use on a container having a top opening and retainer means near the opening, comprising:

(i) a cover dimensioned to completely overlie the opening in the container with a spacer permanently positioned in the approximate center of the cover;

(ii) a force transfer bar permanently positioned over the spacer and extending across the cover from one outer extremity to the other outer extremity, said force transfer bar having means on its first extremity to engage, when properly aligned, a first retaining means found on the container; and (iii) a lever bar pivotably mounted on the force transfer bar's second extremity to engage a second retaining means found on the container and said lever bar being sufficiently long enough so that when the lid member is positioned on the container's top opening with the means on the first extremity of the force transfer bar aligned with the first retaining means of the container and the means on the second extremity of the lever bar aligned with the second retaining means of the container and downward force is exerted on the lever bar, the downward force is transmitted through the spacer to the cover so as to result in substantially equal pressure being exerted by the cover's peripheral edges onto the edges of the container's top opening to form a liquid-tight seal.

2. The lid member of claim 1 further comprising latching means to retain the lever bar in its closed position.

3. The lid member of claim 2 wherein the latching means is a spring-loaded latch hingably attached to the force transfer bar to raise so as to allow the lever bar to pivot about its point of attachment yet hold said lever bar in engagement with the force transfer bar by action of its spring to prevent movement of the lever bar.

4. The lid member of claim 3 wherein the spring-loaded latch engages the lever bar at an extremity opposite where it is pivotably mounted on the force transfer bar.

5. The lid member of claim 2 wherein the latching means is a ring slidably positioned on the force transfer bar and dimensioned to hold the lever bar in its closed position when engaged therein.

6. The lid member of claim 1 wherein the force transfer bar's first extremity extends past the cover's outer edge from about one-half inch to about four inches.

7. The lid member of claim 6 wherein the lever bar's one extremity extends past the cover's outer edge from about one-half inch to about four inches.

8. The lid member of claim 1 wherein the cover is substantially circular in form.

9. The lid member of claim 1 wherein the first extremity of the force transfer bar has a shoulder to restrain its movement relative to the retaining means.

10. The lid member of claim 1 further wherein the force transfer bar has at least one drain hole on a top surface to allow water to pass therethrough.

11. A sealed container article for holding a solid or liquid product, comprising:

(a) a container having a top opening through which the product is added or removed, and characterized in having first and second retainer means mounted thereon near the opening; and (b) a completely removable center-point compression sealing lid member characterized in having:

(i) a cover dimensioned to completely overlie the opening in the container with a spacer permanently positioned in the approximate center of the cover;

(ii) a force transfer bar permanently positioned over the spacer and extending across the cover from one outer extremity to the other outer extremity, said force transfer bar having means on its first extremity to engage, when properly aligned, the first retaining means found on the container; and (iii) a lever bar pivotably mounted on the force transfer bar's second extremity to engage the second retaining means found on the container and said lever bar being sufficiently long enough so that when the lid member is positioned on the container's top opening with the means on the first extremity of the force transfer bar aligned with the first retaining means of the container and the means on the second extremity of the lever bar aligned with the second retaining means of the container and downward force is exerted on the lever bar, the downward force is transmitted through the spacer to the cover so as to result in substantially equal pressure being exerted by the cover's peripheral edges onto the edges of the container's top opening to form a liquid-tight seal.

12. The sealed container of claim 11 further comprising latching means to retain the lever bar in its closed position.

13. The sealed container of claim 12 wherein the latching means is a spring-loaded latch hingably attached to the force transfer bar to raise so as to allow the lever bar to pivot about its point of attachment yet hold said lever bar in engagement with the force transfer bar by action of its spring to prevent movement of the lever bar.

14. The sealed container of claim 12 wherein the latching means is a ring slidably positioned on the force transfer bar and dimensioned to hold the lever bar in its closed position when engaged therein.

15. The sealed container of claim 11 wherein the force transfer bar's first extremity extends past the cover's outer edge from about one-half inch to about four inches.

16. The sealed container of claim 15 wherein the lever bar's one extremity extends past the cover's outer edge from about one-half inch to about four inches.

17. The sealed container of claim 11 further wherein the first extremity of the force transfer bar has a shoulder to restrain its movement relative to the retaining means.

18. The sealed container of claim 11 further wherein the force transfer bar has at least one drain hole on a top surface to allow water to pass therethrough.

19. The sealed container of claim 11 further characterized in the container having a volumetric capacity of at least about one gallon.

* * * * *